United States Patent [19]

Wolbrink et al.

[11] 4,064,798

[45] Dec. 27, 1977

[54] RECEPTACLE FOR TRASH COMPACTORS

[75] Inventors: David W. Wolbrink, Hartford; Robert J. Budyak, Greendale; Du Wayne M. Sellinger, Hartford; William A. Kaepernick, Horicon, all of Wis.

[73] Assignee: Broan Manufacturing Co., Inc., Hartford, Wis.

[21] Appl. No.: 617,090

[22] Filed: Sept. 26, 1975

[51] Int. Cl.[2] ..... B30B 15/06

[52] U.S. Cl. ..... 100/229 A; 100/218; 100/255; 312/303

[58] Field of Search ..... 100/229 A, 255, 218; 312/302, 303, 326, 329

[56] References Cited

U.S. PATENT DOCUMENTS

| | | | |
|---|---|---|---|
| 1,126,073 | 1/1915 | Peterson | 100/218 |
| 1,139,317 | 5/1915 | Wheary | 312/302 |
| 3,714,890 | 2/1973 | Moon | 100/229 A |
| 3,741,108 | 6/1973 | Stratman | 100/229 A |
| 3,868,903 | 3/1975 | Montalbano | 100/229 A |
| 3,882,771 | 9/1973 | Frohbieter | 100/53 |
| 3,901,139 | 8/1975 | Moriconi | 100/48 |

*Primary Examiner*—Billy J. Wilhite

*Attorney, Agent, or Firm*—Andrus, Sceales, Starke & Sawall

[57] ABSTRACT

An improved receptacle for a trash compactor is mounted on a drawer for movement into and out of the compactor along rails on the drawer. The receptacle is spaced from the rails so that dents or deformations of the receptacle do not affect the rails. The rear end wall of the compactor may be slanted so as to accommodate the arcuate travel of the ram of the compacting mechanism and the receptacle has a pyramidal shape to facilitate removal of the compacted trash.

13 Claims, 8 Drawing Figures

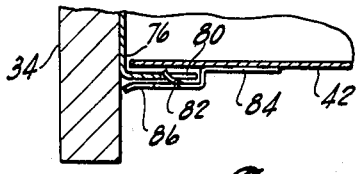
Fig. 8
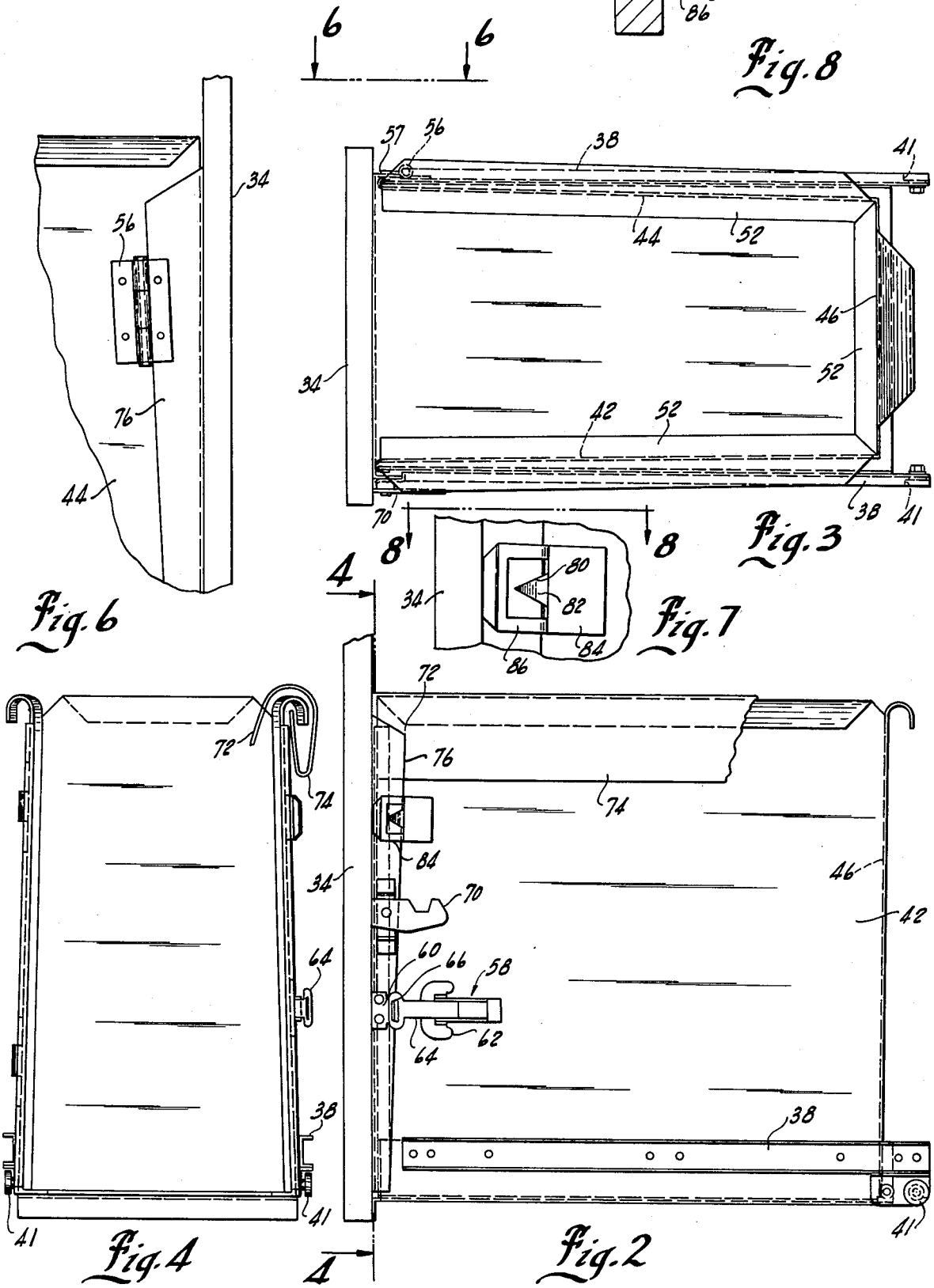
Fig. 6
Fig. 3
Fig. 7
Fig. 4
Fig. 2

RECEPTACLE FOR TRASH COMPACTORS

BACKGROUND OF THE INVENTION

1. Field of the Invention

The present invention relates to an improved trash receiving and compaction receptacle for trash compactors.

2. Description of the Prior Art

Household trash compactors typically include a compaction mechanism having a motor driven platen or ram which descends by means of an extensible linkage into a trash containing receptacle to effect compaction. The compaction mechanism and receptacle may be contained in a cabinet having a drawer on which the receptacle is mounted. The drawer is slidable out of the cabinet along rails so as to permit the insertion of trash and the removal of compacted trash. The drawer is slid into the cabinet to position the receptacle beneath the ram for compaction.

The receptacle is lined with a bag in which the compaction actually occurs and which holds the compacted trash. The receptacle and the bag are usually sized to accommodate the weight of accumulated compacted trash which can be conveniently carried out. The bag is removable from the receptacle for deposit in the garbage.

The major purpose of trash compactors is to compress relatively rigid articles to a fraction of their original size thereby greatly reducing the bulk of the trash. Such relatively rigid articles include particularly glass bottles and to a lesser extent, tin cans. The forces required to crush glass bottles, for example, soft drink bottles, can be quite high. During the application of the ram to rigid articles such as bottles, the bottle may contact the sides of the receptacle. Both denting and distortion of the receptacle by the rigid article may result as the crushing forces of the ram attain and exceed the breaking strength of the articles. In the past, this physical alteration of the receptacle has made it difficult to slide the receptacle into and out of the cabinet because of the bulges produced by denting and/or the misalignment of the drawer rails produced by distortion of the receptacle.

Several additional problems have also heretofore occurred in connection with the design and use of trash compactor receptacles. For example, it is important to securely fix the bag in the receptacle so as to prevent it from being withdrawn from the receptacle by the ram as it retracts, particularly when only a small amount of trash is contained in the bag. In the past, complicated clamp arrangements have been employed around the top of the receptacle for bag retention purposes. These clamp arrangements tend to be both expensive and difficult for the homeowner to use.

Trash compactors of the type shown in U.S. Pat. No. 3,714,890 to Jerry W. Moon employ a compaction mechanism having a motor coupled to the ram through an extensible linkage system of the scissors jack or lazy tongs type. The path of the ram during descent is slightly curved and it is necessary for the receptacle to accommodate this arc.

The compaction of the trash tends to expand the trash causing it to wedge in the bag. This makes the bag difficult to remove, particularly in view of the weight of the accumulated trash.

SUMMARY OF THE PRESENT INVENTION

The present invention addresses itself to the solution of the foregoing problems relating to trash compactor receptacles.

The present invention thus provides an improved receptacle for a trash compactor in which distortion and denting of the receptacle caused by the compaction of bottles or other rigid or brittle objects do not prevent or interfere with the movement of the drawer into and out of the trash compactor.

The receptacle of the present invention incorporates a simple means for retaining the bag in the receptacle against removal sources exerted by the ram and facilitates removal of the compacted trash from the compactor.

Another object of the present invention is to provide a receptacle which accommodates arcuate travel of the ram.

In the present invention a drawer provides access to the interior of the compactor. The drawer has front panel mating with the compactor cabinet for permitting access to the cabinet when open and for blocking access when closed. The drawer also includes a horizontal support means having parallel rails cooperable with the cabinet or frame of the compactor for sliding the drawer between the open and closed positions.

The receptacle includes the drawer front, side walls and a rear end wall. The side walls are spaced from the parallel rails so that denting or other distortion of the side walls as a result of compaction does not alter the position of the rails and the sliding action of the drawer.

Preferably the front panel is hinged along one of the vertical edges of the side walls and the rear end wall is smaller in dimension than the hinged door so that the spacing of the side walls from the parallel rails is provided by tapering the side walls toward the rear of the receptacle.

The receptacle may be conveniently formed from a single, generally rectangular, metal sheet. The fold lines between the end walls and the side walls are oriented with a convergence. This fabrication provides the necessary spacing from the rails, a slant to the back which accommodates the arc in the movement of the compacting ram and a slight pyramidal shape to the receptacle which facilitates removal of the bag containing the compacted trash.

The side walls may receive an overlying cuff of the bag along their exterior. The door is provided with flanges which extend along the side walls of the receptacle when the door is closed to clamp the bag in the receptacle by pinching the cuff between the side walls of the receptacle and the flanges.

BRIEF DESCRIPTION OF THE DRAWING

FIG. 2 is a side elevational view of the improved receptacle of the present invention.

FIG. 3 is a plan view of the improved receptacle shown in FIG. 2.

FIG. 4 is a view taken along the line 4—4 of FIG. 2 looking into the receptacle of the present invention just behind the front panel of the receptacle.

FIG. 6 is an enlarged partial elevational view taken along the line 6—6 of FIG. 3 showing the manner in which the front panel is hinged on the remaining portions of the receptacle.

FIG. 7 is a fragmentary side view of the receptacle showing a recess and projection means used to insure alignment of the front panel with the side wall of the receptacle.

FIG. 8 is a fragmentary top view of the recess and projection means taken along the line 8—8 of FIG. 7.

DESCRIPTION OF THE PREFERRED EMBODIMENT

Figure 1:
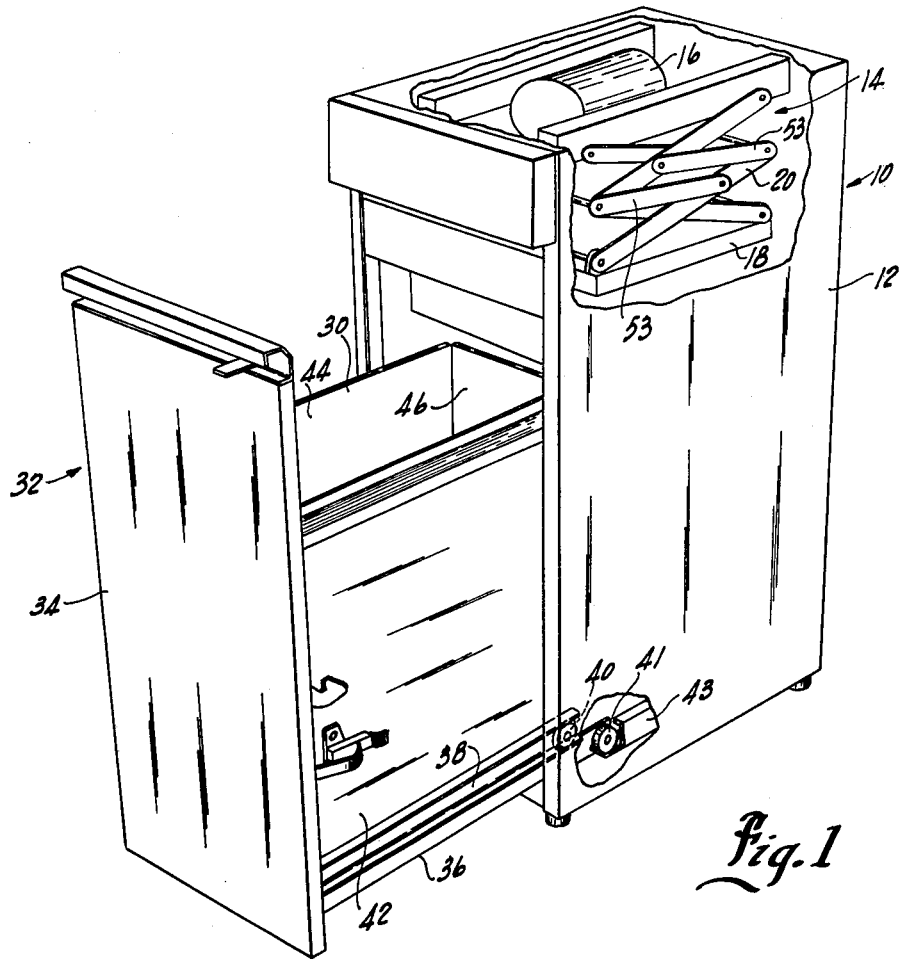
FIG. 1 is a perspective view of a trash compactor showing the improved receptacle of the present invention.
Figure 5:
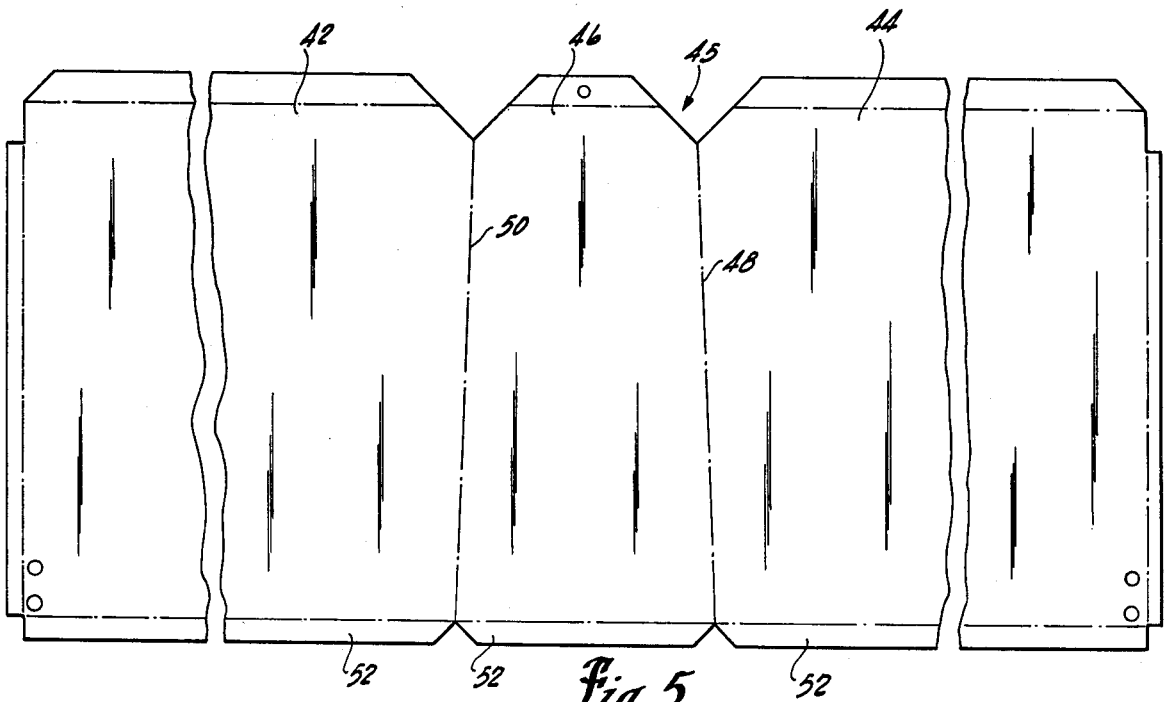
FIG. 5 is an elevational view showing the sheet of material used to form the side and end walls of the receptacle of the present invention.

Turning now to the Figures, there is shown in FIG. 1 a trash compactor identified by the numeral 10. Trash compactor 10 includes a cabinet 12 containing compacting mechanism 14 in the upper portions thereof. Compacting mechanism 14 is powered by motor 16 coupled to compacting platen or ram 18 through a lead screw, nut, and extensible linkage 20 in the manner described in detail in the aforesaid Moon patent.

Receptacle 30 for receiving the trash to be compacted is positioned in the lower portion of cabinet 12 in drawer 32. Drawer 32 includes front panel 34 formed of a portion of one of the vertical walls of the cabinet. A support deck 36 is positioned adjacent the lower portion of front panel 34. Drawer 32 is movable into and out of cabinet 12 by means of horizontal, parallel, rails 38 mounted on either side of support deck 36. Rails 38 engage rollers 40 mounted on the inside of cabinet 12. Rollers 41 mounted on receptacle 30 engage rails 43 mounted on the inside of cabinet 12.

Front panel 34 of drawer 32 also forms the front wall of receptacle 30. Receptacle 30 contains opposing side walls 42 and 44 and rear end wall 46. Side walls 42 and 44 are spaced inwardly on support deck 36 so that dents or distortions in the side walls, generated as a result of the compaction of bottles or other rigid or brittle objects in receptacle 30 do not affect or alter rails 38 and the movement of drawer 32 into and out of cabinet 12. For this purpose, and as shown most clearly in FIG. 3, rear end wall 46 may have a smaller lateral dimension than the portion of front panel 32 forming the front wall of receptacle 30 so that said walls 42 and 44 slant away from parallel rails 38 to provide the desired spacing. The need for spacing is not as critical in the forward portions of receptacle 30 due to the bracing provided by front panel 34, thus permitting the tapered configuration of receptacle 30.

Side walls 42 and 44 and rear end wall 46 may conveniently be formed of a single sheet 45 of material, such as metal. The fold lines 48 and 50 between side walls 42 and 44 and end wall 46 are formed with a convergence in the upward direction so that when the metal is bent along the fold lines and mounted on support deck 36, side walls 42 and 44 are non parallel to rails 38 and end wall 46 slants inwardly at the upper end as shown in FIGS. 3 and 2, respectively. Flanges 52 of sheet 45 are bent inwardly with respect to the completed receptacle and welded to support deck 36, as shown in FIG. 3.

The inward slant of rear end wall 46 is of significance in accommodating any arcuate movement in the travel of ram 18. Such arcuate movement is produced by stabilizing links 53 in the extensible linkage 30 and causes the ram to move toward the front and then to the center of compactor 10 during its descent. The inward slant of rear end wall 46 permits ram 18 to descend into receptacle 30 without interference, while at the same time providing the relatively close fit between the ram and the receptable which insures good compaction.

The fold lines 48 and 50 in sheet 45 provide a truncated pyramidal configuration to receptacle 30 which facilitates removal of the compacted trash by obviating the wedging produced by expansion of the trash upon compaction. The pyramidal configuration also lessens the force applied to receptacle 30 by positioning sidewalls 42 and 44 more nearly parallel to the resultant compacting force. It also acts to reduce subsequent upward expansion of the trash.

Front panel 34 may be pivotally mounted on one of side walls 42 and 44 by hinges 56, as shown most clearly in FIG. 6. Hinges 56 may be mounted on flange 76 of front panel 34, the purpose of which is hereinafter described. The opposite side wall 42 contains toggle catch 58 which retains door 34 in the closed position. Specifically, front panel 34 contains projection 60. Toggle mechanism 62 having arm 64 containing opening 66 for receiving projection 60 is mounted on side wall 42.

When drawer 32 is slid into cabinet 12, it is retained in the cabinet by catch 70 which engages locking means, not shown, in the cabinet.

Receptacle 30 is customarily lined with a bag 72 which receives the trash, retains the compacted trash, and which may be removed through front panel 34 for disposal. The upper edges of particularly side walls 42 and 44 may be rolled, as shown most clearly in FIG. 4, to facilitate forming a cuff 74 with the upper portions of bag 72 which assists in positioning the bag in receptacle 30.

It will be appreciated that the retraction of ram 18 from receptacle 30 tends to remove bag 72 from receptacle 30 when the bag is lightly loaded. This is particularly acute in the forward portions of the receptacle due to the forward displacement of the ram during the arcuate movement occuring in its ascent.

To retain bag 72 in receptacle 30, front panel 34 contains flanges 76 extending along the exterior of side walls 42 and 44 for pinching cuff 74 of bag 72 between the flanges and the side walls as shown in FIG. 2 to prevent dislodgement of the bag by the ram. Hinges 56 may be mounted on one of the flanges 76 so that the flange is properly positioned when front panel 34 is closed.

To position front panel 34 during closure against misalignment caused by flexure of drawer 32 due to the weight of front panel 34, a triangular recess 80 is provided in flange 76 of front panel 34 which is adjacent side wall 42 when the panel is closed. Recess 80 engages triangular projection 82 of bracket 84 on side wall 42 as front panel 34 is closed by toggle mechanism 62. The guide portion 86 of bracket 84 which surrounds projection 82 insures the engagement of the projection in recess 80.

In operation, front panel 34 is unlatched with toggle latch 58 and swung open by hinges 56 to allow bag 72 to be inserted in receptacle 30. Cuffs 74 are formed in bag 72. Preferably a double cuff is formed so that the edge of bag 72 is located under the rolled upper edge of side walls 42 and 44.

The forward edges of the cuffs are smoothed along side walls 42 and 44. Front panel 34 is then swung shut so that flanges 76 pinch the forward ends of cuffs 74 against the outer surfaces of side walls 42 and 44.

Trash is then deposited in bag 72 and drawer 30 slid shut along rails 38 an rollers 40. Compacting mechanism 14 is operated to insert ram 18 into bag 72 to compact the trash. The ram is returned to the upper storage position shown in FIG. 1 at the completion of the compaction process. Drawer 32 may then be opened, additional trash inserted in receptacle 30 and the compaction process repeated.

When the desired amount of trash has been compacted in receptacle 30, toggle latch 58 is loosened, front panel 34 swung open and bag 72 containing the trash removed from receptacle 30. The pyramidal configuration of receptacle 30 shown in FIG. 4 assists in the removal of the trash as does the divergence of side walls 42 and 44 in the forward direction and the flexibility of side walls 42 and 44 provided by their sheet metal construction.

While a compactor 10 having a cabinet 12 is shown, it will be appreciated that the receptacle construction of the invention is equally suitable for use with a compactor of the built-in type. In such a compactor a frame work having a front wall is provided for mounting compaction mechanism 14 and for receiving drawer 32.

Various modes of carrying out the invention are contemplates as being within the scope of the following claims particularly pointing out and distinctly claiming the subject matter which is regarded as the invention.

We claim:

1. In a trash compactor having a positioning means for mounting a compaction means along a compaction axis, the improvement comprising:

a support deck having generally parallel movement means mounted on either side thereof engagable in said positioning means for moving said support deck with respect to said positioning means in a direction generally perpendicular to said compaction axis;

a generally rectangular receptacle for containing the trash to be compacted, said receptacle including a wall means having a pair of planar side walls and a rear end wall formed of flexible sheet material, said wall means being affixed to a surface of said support deck intermediate said movement means so that said surface of said support deck forms a bottom for said wall means, said receptacle being positionable along said compaction axis and sized to receive said compaction means, said planar side walls being spaced inwardly from the sides of said deck and said movement means a distance sufficient to prevent deflection or distortion of said receptacle from affecting the operation of said movement means; and a front panel hingedly retained on at least one of said support deck and wall means for movement between a closed position in which said front panel abuts the forward portions of said side walls to form a front end wall of said receptacle and an open position permitting removal of the compacted trash from said wall means, said front panel being mateable with said positioning means and forming, with said support deck, a drawer for the trash compactor, said front panel having flange means for embracing the forward portions of said side walls when said front panel is in the closed position along substantially the entire dimension in abutment with said front panel, said flange means being formed to permit the hinged movement of said front panel with respect to said side walls and to brace the forward portion of said side walls when said front panel is closed while allowing said side walls to flex when said front panel is open.

2. The improvement according to claim 1 wherein said spacing of said side walls from said movement means is obtained by forming said side walls of said wall means so as to generally converge towards each other and to diverge with respect to said parallel movement means.

3. The improvement according to claim 2 wherein said rear end wall is smaller in lateral dimension than said front panel, thereby to provide a rearward convergence to said side walls.

4. The improvement according to claim 3 wherein said compaction means includes a ram mounted on an extensible linkage means, said ram having an arcuate path of travel from the front toward the rear of said receptacle along the compaction axis and wherein said rear end wall of said receptacle is formed as to diverge from said compaction axis in the direction of extension of said linkage means, thereby to accommodate the arcuate path of said ram.

5. The improvement according to claim 4 wherein said side walls and rear end wall are formed of a single sheet of bent material, the fold lines between said rear end walls and side walls lying at a converging angle thereby to provide the divergence to the rear end wall and a pyramidal taper to said side wall for relieving the wedging action of the compacted trash in the receptacle.

6. The improvement according to claim 2 wherein said side walls are so formed as to be pyramidally tapered along the compaction axis in a direction extending away from said support deck, thereby to relieve the wedging action of the compacted trash in the receptacle.

7. The improvement according to claim 1 wherein said side walls are so formed as to be pyramidally tapered along the compaction axis in a direction extending away from said support deck, thereby to relieve the wedging action of the compacted trash in the receptacle.

8. The improvement according to claim 1 wherein said receptacle is suitable for receiving a bag in which compaction occurs, said bag having a cuff extending along the exterior of said side walls, wherein said flange means is contiguous with the forward portions of said side walls when said door is closed for clamping said cuff between said flanges means and said side walls for retaining the bag in the receptacle against removal forces exerted by the compaction means.

9. The improvement according to claim 8 wherein said front panel is hinged on one of said side walls.

10. The improvement according to claim 1 wherein said front panel and one of said side walls has means engageable when said front panel is in the closed position for positioning said front panel in a predetermined location with respect to said side walls.

11. In a trash compactor having a positioning means for mounting a compaction means along a compaction axis, the improvement comprising:

a support deck having generally parallel movement means mounted on either side thereof engagable in said positioning means for moving said support deck with respect to said positioning means in a direction generally perpendicular to said compaction axis;

a generally rectangular receptacle for containing the trash to be compacted, said receptacle including a wall means having a pair of planar side walls and a rear end wall, said wall means being affixed to a surface of said support deck intermediate said movement means so that said surface of said support deck forms a bottom for said wall means, said receptacle being positionable along said compaction axis and sized to receive said compaction means, said planar side walls being spaced inwardly from the sides of said deck and said movement means a distance sufficient to prevent deflection or distortion of said receptacle from affecting the operation of said movement means, said walls being so formed as to be pyramidally tapered along the compaction axis in a direction extending away from said support deck, thereby to relieve the wedging action of the compacted trash in the receptacle and a front panel coupled to at least one of said support deck and wall means for forming a front wall closing and receptacle, said front panel forming, with said support deck, a drawer for the trash compactor.

12. In a trash compactor having a positioning means for mounting a compaction means along a compaction axis, the improvement comprising:

a support deck having generally parallel movement means mounted on either side thereof engagable in said positioning means for moving said support deck with respect to said positioning means in a direction generally perpendicular to said compaction axis;

a generally rectangular receptacle for containing the trash to be compacted, said receptacle including a wall means having a pair of planar side walls and a rear end wall, said wall means being affixed to a surface of said support deck intermediate said movement means so that said surface of said support deck forms a bottom for said wall means, said receptacle being positionable along said compaction axis and sized to receive said compaction means, said planar side walls being spaced inwardly from the sides of said deck and said movement means a distance sufficient to prevent deflection or distortion of said receptacle from affecting the operation of said movement means; and a front panel coupled to at least one of said support deck and wall means for forming a front wall closing said receptacle, said front panel forming, with said support deck, a drawer for the trash compactor, said receptacle being suitable for receiving a bag in which compaction occurs, said bag having a cuff extending along the exterior of said side walls, said front panel being movable with respect to said side walls between open and closed positions, said front panel having flange means contiguous with the forward portion of said side walls when said front panel is closed for clamping said cuff between said flange means and said side walls for retaining the bag in the receptacle against removal forces exerted by the compaction means.

13. The improvement according to claim 12 wherein said front panel is hinged on one of said side walls.

* * * * *